United States Patent [19]

Davitz

[11] 4,243,146

[45] Jan. 6, 1981

[54] CUSTOM CHANGEABLE HANGING RACK FOR FINISHING SYSTEM

[75] Inventor: Walter E. Davitz, Columbus, Ohio

[73] Assignee: Production Plus Corporation, Columbus, Ohio

[21] Appl. No.: 41,944

[22] Filed: May 24, 1979

Related U.S. Application Data

[63] Continuation of Ser. No. 28,277, Apr. 9, 1979.

[51] Int. Cl.[3] ..... A47F 5/08

[52] U.S. Cl. ..... 211/118; 118/500; 204/297 W; 211/119

[58] Field of Search ..... 211/113, 119, 118; 118/500; 204/297 W

[56] References Cited

U.S. PATENT DOCUMENTS

| | | | |
|---|---|---|---|
| 2,058,217 | 10/1936 | Dixon | 211/119 |
| 2,954,222 | 9/1960 | Evans | 211/119 X |
| 4,037,727 | 7/1977 | Kunkle | 204/297 W |
| 4,097,359 | 6/1978 | Davitz | 211/116 X |

*Primary Examiner*—Roy D. Frazier
*Assistant Examiner*—Robert W. Gibson, Jr.
*Attorney, Agent, or Firm*—Frank H. Foster

[57] ABSTRACT

A support rack having a main frame and workpiece support hooks on which workpieces are hung for transporting through a finishing system. The rack has a plurality of horizontal, vertically spaced crossbars each constructed of a U-shaped, downwardly opening channel member having a pair of side panels and a cross web connecting the panels extending between and longitudinally along the panels. A plurality of crossbeams, at least one near each end of each crossbar, extend between the panels and are spaced below the cross web. A plurality of manually removable sidebars extend between the adjacent vertically spaced ends of the crossbars. Each sidebar has a hook-shaped upper end for hanging over an upper one of the crossbeams and a lower, inwardly bent leg which extends along the underside of the cross web and above the crossbeam of a relatively lower crossbar to a downturned tip. A removable retaining means is inserted between each of the lower legs on the sidebar and its associated crossbeam for extending from the crossbeam to the leg for preventing significant movement of the leg and for interfering with the downturned tip to prevent withdrawal of the leg from the sidebar.

9 Claims, 11 Drawing Figures

CUSTOM CHANGEABLE HANGING RACK FOR FINISHING SYSTEM

TECHNICAL FIELD

This is a continuation in part of my copending application Ser. No. 028,277 filed Apr. 9, 1979.

This invention relates to gang hangers of hook racks which are fabricated of metal and used for supporting many individual workpieces as they are conveyed through a finishing system for cleaning, preparing and coating the workpieces. More particularly, this invention relates to electrically conductive support racks which can be manually disassembled and assembled in a variety of sizes for use in finishing systems which include the electrostatic spray coating of liquid or dry charged particles onto workpieces at a coating station such as a paint spray booth. The support racks have interchangeable sidebars which can be prefabricated in a variety of sizes and used to assemble racks of customized sizes which can be changed as desired by the owner.

BACKGROUND ART

Finishing support racks usually have several, vertically stacked, horizontal rows or tiers of protruding, article-engaging hooks upon which workers hang workpieces for surface finishing. The hooks are connected to vertically spaced, horizontal crossbars which in turn are conventionally welded or bolted together at their opposite ends to vertical sidebars.

One workpiece supporting rack which is shown in the prior art is described in U.S. Pat. No. 4,097,359 and the patents referred to therein. Still another work holder is shown in U.S. Pat. No. 2,904,492.

The article engaging portion of the hooks may be constructed in a variety of shapes. Ordinarily each hook is simply a piece of wire having its article-engaging end bent into a hook shape. The term hook is utilized, however, to include the great variety of configurations which may be devised for engaging workpieces.

Finishing support racks are suspended from a conveyer and a large number of parts or workpieces are connected to the hooks of the rack. The rack and its suspended workpieces travel through a finishing system having a series of stations at which the workpieces may be sequentially treated by one or more of the steps of cleaning, rinsing, surface preparation such as undercoating, rinsing again, drying, coating and baking. Workers then remove the finished parts and reuse the racks.

Although the racks may be reused for more parts of the same type, eventually a particular job is completed and the rack may later be used for finishing other parts in connection with another job. However, each job is somewhat unique. Not only do parts vary in size from job to job, but they may come in different types of groupings of part sizes and configurations. For example, parts can be large or small, elongated, bulky or compact and additionally, where several parts for a particular assembly are finished together, some groups may have many small parts and a few large ones, other groups of parts may have many large and a few small parts and still other groups may have still a different variety or mixture of parts, sizes and shapes.

It is desirable that all parts which are to be finished be supported as closely together as possible consistent with permitting a quality finish to be obtained. By positioning the parts closer together on the rack, there is less empty or open area between the parts through which paint or coating material is sprayed and not coated on a part. Reduction of the open area reduces the need for expensive recycling of coating materials and the associated material loss in recycling processes. Furthermore, closer spacing permits more parts to pass through the finishing system on each rack thereby increasing the finishing rate and improving overall efficiency.

Prior art finishing support racks are conventionally welded or bolted together. Welding irrevocably commits the particular rack and the capital investment which is required to one unique size and spacing. The use of exposed bolts has the same effect because the bolts become coated and can not be unfastened thereby preventing disassembly of the rack. Although the rack may be excellent for one job it will be less efficient for most others. It is therefore an object of the present invention to provide a sturdy and durable support rack which the owner can purchase and thereafter change as he desires in order to space the hooks to efficiently accommodate each particular group of parts being finished for each job.

Still another object of the present invention is to provide a finishing support rack constructed of components which can be prefabricated and warehoused and later assembled as needed. The required components may be selected in accordance with a purchase order to form finishing support racks of a particular desired size. Not only may the support racks be shipped immediately because no further construction is necessary, but they may be shipped in a disassembled condition and therefore may be shipped in a very compact package which saves shipping expenses.

Additionally, it is an object of the invention to provide rack sidebars in a variety of sizes so that different sizes may be used to assemble and change the support rack with a different vertical crossbar spacing. A user need only stock a variety of relatively inexpensive sidebars at considerably less cost than stocking a variety of entire racks and yet can have the same variety of rack sizes available to him.

Finishing support racks are constantly recycled through the finishing system and become encrusted with multiple layers of coating material. In electrostatic painting, the coating particles are electrically charged and directed toward a suspended workpiece. The workpiece is electrically connected to the ground potential through the conductive support rack so that the coating material is attracted by a static electric field to the suspended workpieces. It is extremely important that the electrical contact between the sidebars and the crossbars and between each support hook and its crossbar be maintained as a good, low resistance electrical contact so that the suspended workpiece will remain well grounded. The accumulation of nonconductive or high resistance coating particles between these interconnected rack components must be prevented.

If the coating material is applied to the contacting, interfacing surfaces of these rack components it will create a high resistance in the circuit from ground to the workpiece which will inhibit electrical current flow. The current flow is necessary in order to supply electrons for neutralizing the charge of the coating particles after they are deposited on the suspended workpieces so that subsequently arriving, positively charged particles will be uniformly attracted to the workpieces. The undesirable electrical charge in the area of the workpieces being painted upon the support racks. The buildup of charge would reduce the attraction of the workpiece to the coating material causing uneven coating and creating a potential spark hazard.

A single painting or coating operation applies a coating layer to the exposed crossbars, sidebars and support hooks of the rack. This layer usually entirely covers the hooks except for the small area of direct contact with each suspended workpiece. Often a hook can be reused for an identical workpiece which will be in electrical contact with the hook at the identical place. However, for a workpiece which is positioned differently on the hook, even one layer of coating material reduces the electrical contact of the hook with the workpiece.

It is therefore desirable that the hooks of the support rack be detachably engaged to the main frame of the rack so that the hooks may be periodically removed, cleaned and replaced. Alternatively, they may be removed and replaced with new hooks or with ones of a different size or shape to accommodate different workpieces.

Another major difficulty with the prior art finishing support racks is the difficulty of removing the hooks from the main frame of the rack. Some require extensive manual manipulation while others require stripping and disassembly of the rack. Another disadvantage is that the prior art racks are more expensive to construct because they require more metal and more manufacturing operations than the rack of the present invention. Because of the manner that the hooks are attached to the main frame of prior art racks, they have a further disadvantage that the wire size used for the hooks of a particular prior art rack is narrowly limited to the particular wire size for which the rack was designed.

It is therefore another object of the present invention to provide a versatile finishing support rack which has hooks which are removable or replaceable with a minimum of human manipulation and with hooks of a broad range of wire sizes and yet provides a finishing support rack which is of a stronger and sturdier construction and easier to fabricate than prior art racks and still provides complete shielding of the electrical contacts between the hooks and the crossbars and between the crossbars and the sidebars of the support rack.

BRIEF DISCLOSURE OF THE INVENTION

The present invention is a finishing support rack of the type having a main frame and workpiece support hooks on which workpieces are hung for transporting the workpieces through a finishing system. The rack, in its operable position, has a plurality of generally horizontal, vertically spaced crossbars each crossbar formed, for example, as a narrow inverted, U-shaped, channel member with opposed spaced panels. Each crossbar includes a cross web connected between and extending longitudinally along the crossbar panels and at least one crossbeam near each end of the crossbar extending between the panels and spaced from the cross web. Preferably, a pluralty of crossbeams are formed along the crossbars for the attachment of support hooks. A plurality of manually removable sidebars extend between the adjacent, vertically spaced ends of the crossbars, each sidebar preferably having a hook-shaped upper end for hanging over an upper one of the crossbeams and a lower inwardly bent leg extending along the underside of a cross web and above a crossbeam of a relatively lower one of the crossbars to a downturned tip. A removable retaining means is inserted between each lower leg and its associated crossbeam. The retaining means extends essentially from the crossbeam to the leg for preventing significant movement of the leg and for interfering with the turned down tip to prevent withdrawal of the leg. The retaining means may be a variety of configurations including the upper hook-shaped end of another removable sidebar which extends down to a still lower crossbar. For the bottom crossbar, the retaining means may be the upper rack engaging portion of a support hook. Still other retaining means are disclosed. The support hooks are preferably formed in the manner described herein and claimed in my copending application referred to above.

DESCRIPTION OF THE PREFERRED EMBODIMENT

Figure 1:
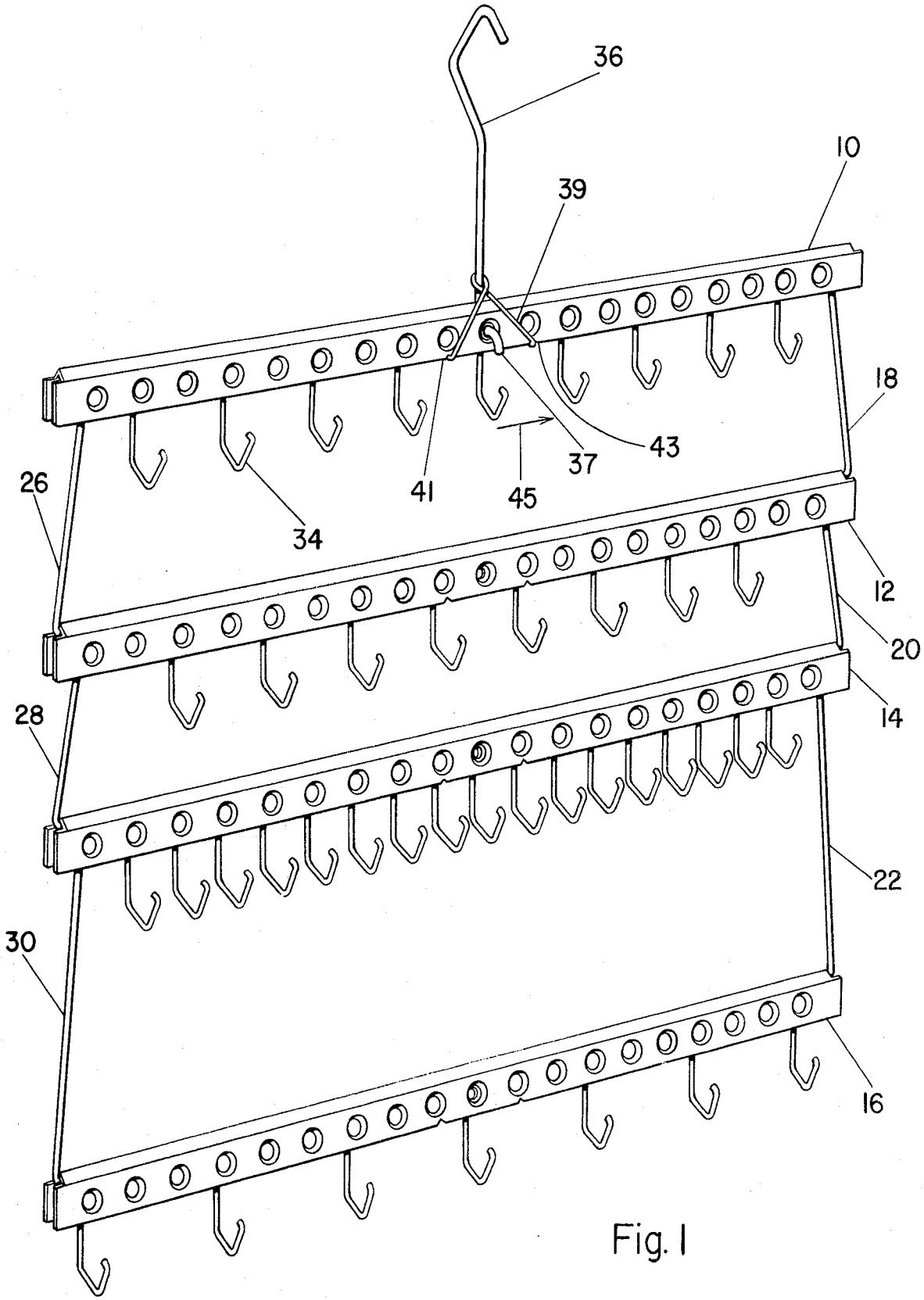
FIG. 1 is a view in perspective of an entire finishing support rack embodying the present invention.

FIG. 1 illustrates a finishing support rack which is constructed in accordance with the principles of the present invention. It comprises a plurality of generally horizontal, vertically spaced crossbars 10, 12, 14 and 16 and a plurality of manually removable sidebars 18, 20, 22, 26, 28 and 30 and which extend between the adjacent, vertically spaced ends of the crossbars 10 through 16.

A plurality of workpiece support hooks, such as support hook 34, are connected at spaced intervals along the crossbars. Workpieces are hung upon these hooks for transporting the workpieces through the finishing system. Preferably, all of these parts are constructed of steel although other metals may be preferable for some uses, such as copper for the plating industry. The upwardly extending conveyer hook 36 is connected to the uppermost crossbar 10 for engaging the conveyer system of the finishing system and supporting the rack as it travels through the finishing system.

Figure 3:
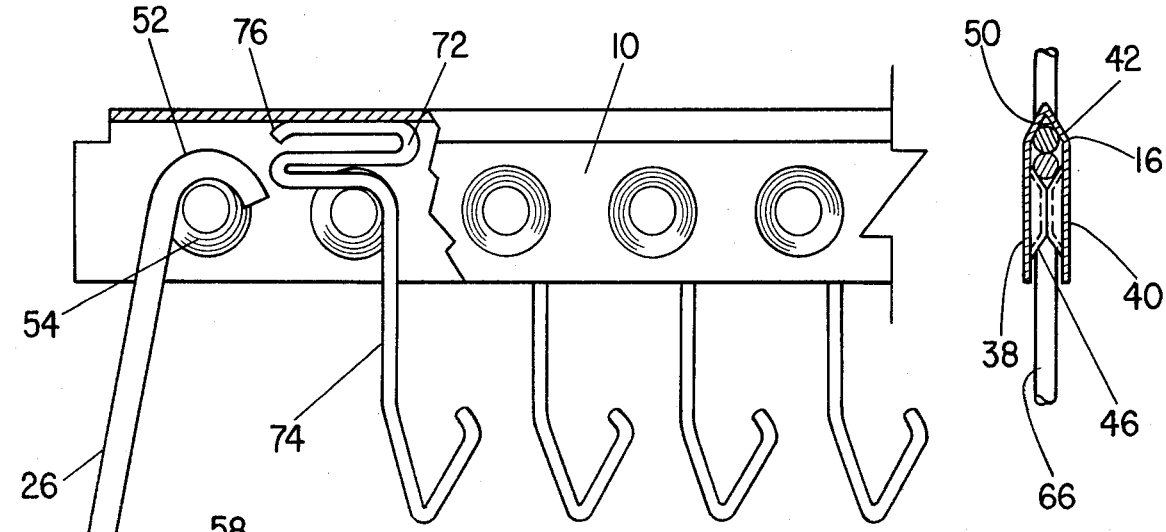
FIG. 3 is a view in vertical section taken substantially along the line 3—3 of FIG. 2.
Figure 2:
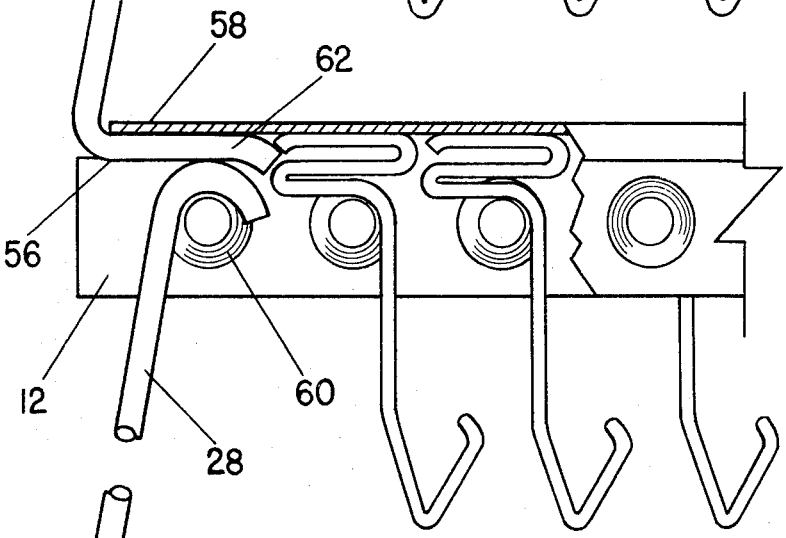
FIG. 2 is a view of a portion of the support rack illustrated in FIG. 1 with segments removed to illustrate the interconnection of the sidebars, crossbars and support hooks embodying the present invention.

Referring now to FIGS. 2 and 3, the preferred crossbars each comprise a horizontal, downwardly opening, U-shaped channel member such as the channel member of crossbar 16. The channel member includes a pair of spaced panels or legs 38 and 40 which are connected by a cross web 42 at the top of the crossbar extending longitudinally along the panels 38 and 40. A plurality of crossbeams, such as crossbeam 44, are connected between the panels or legs 38 and 40. The crossbeams are arranged longitudinally along each crossbeam and are spaced from each other and spaced below the cross web 42. The endmost crossbeams of each crossbar are normally used primarily for engaging the sidebars constructed in accordance with the present invention.

Although the crossbeams can be constructed in a variety of structural forms, such as bolts or rods welded in opposing holes, I prefer to form these crossbeams from a pair of opposite, inwardly tapering, frusto-conical projections or bosses which are embossed into the panels of channel members. These bosses or projections are connected together, for example by spot welding or metal stitching, to form an annular beveled groove, such as groove 46, around each crossbeam.

Attaching these bosses together to form the crossbeam in this manner not only prevents the separation of these bosses when they are engaged with the hooks or the sidebars and the support rack is loaded down with workpieces as described below, but this attachment also improves the rigidity and strength of the crossbars so that they resist deflection from the weight of the workpieces which are hung upon the hooks.

Typically, nineteen crossbeams are formed on each crossbar. However, they may be formed at any desired spacing or at irregular spacings in any desired numbers. For example, there may be different spacings in a single rack for accommodating the painting of different but similarly colored parts of a single assembly.

Each crossbar may be formed from a single, flat sheet which is embossed with the frusto-conical projections and then bent around to the U-shaped configuration. In so doing, it is preferred that the cross web of the channel member be formed to taper inwardly and upwardly to form an interior bevelled groove. As described below, this interior bevelled groove, such as groove 50, along with the annular bevelled grooves which are formed around each of the crossbeams, provide receiving seats for the interlocking sidebars and for the crossbar engaging portion of each of the support hooks. Although not essential, these grooves retain the sidebars and also the support hooks in the center of the crossbars and restrain them from lateral movement or side play toward the panels of the U-shaped crossbars.

Each of the sidebars, such as sidebar 26, has a hook-shaped upper end 52 for hanging over an upper one of the crossbeams, such as crossbeam 54. The sidebar 26 like the other sidebars has a lower, inwardly bent leg 56 which extends along the underside of the cross web 58 of the relatively lower crossbar 12 and above the crossbeam 60. The sidebar then is bent into a down turned tip 62.

A removable retaining means is inserted between the lower leg 56 and its associated crossbeam 60 for extending from the crossbeam 60 to the leg 58 for preventing significant movement of the leg 58 and preferably for holding it in place. The retaining means also interferes with the down turned tip 62 to prevent the withdrawal of the leg.

The removable retaining means may be in a variety of many different shapes. If there is to be a still lower crossbar in the finishing support rack, then the retaining means is the hook-shaped upper end of yet another sidebar, such as sidebar 28, which extends downwardly to the next lower crossbar 14.

However, a convenient removable retaining means for the bottom sidebar 16 is the upper, hook-shaped, crossbar engaging portion 64 of a workpiece support hook 66 or a piece of similarly sized bar stock which terminates below the phantom line 67 and serves only as a retaining means for the bottom crossbar. Preferably, the hook-shaped portion of both the support hook 66 and the sidebar 28 are formed of bar stock having a diameter such that they fit between the lower leg of the relatively higher sidebar and the associated crossbeam with only a minimum of excess clearance which is sufficient to allow easy insertion and removal.

However, another and very convenient removable retaining means is the rack engaging portion of the support hooks. Each of the support hooks has a workpiece engaging portion, such as the workpiece engaging portion 74, and a crossbar engaging portion such as crossbar engaging portion 72.

In order to provide a conveyer hook 36 which is conveniently, manually removable and yet operably sturdy, I have provided a central bore 37 through the centermost crossbeam of eacg crossbar and have bent the lower end of the conveyor hook 36 into a double right angle to form a crank which is inserted through the bore 37 and held in place on the crossbar 10 by means of a wire brace 39.

Notches, such as notches 41 and 43, are formed symmetrically of this central bore 37 in the bottom edges of the sidebars. I prefer to provide four notches, two on each edge, and a central bore in each crossbar so that each crossbar is available for use as the top crossbar or as a lower crossbar of the support rack. The wire brace 39 is looped around the conveyor hook 36 and extends downwardly at each end to a sharp, inwardly turned hook which is caught in the notches, such as notches 41 and 43. The wire is biased by its own resilience into the notches. The notches are positioned so that the wire can be removed by merely pivoting it in the direction shown by arrow 45, to remove it from the notch to release the wire and thereby easily permit its removal from the conveyer hook 36. Conveyer hooks may be supplied in different lengths and the hook portion may be parallel to the plane of the rack or transverse thereto. After the racks have been coated a few times the conveyer hooks will not be removable, except after stripping, because they and the wire braces will be coated.

The workpiece engaging portion of each support hook is customarily bent into a hook-shaped end but also may be in any other configuration suitable for engaging and supporting particular workpieces. Often this portion is custom designed to accommodate particular problems with particular workpieces. It may, for example, extend laterally of the support rack or it may extend forwardly to hold the workpieces out and away from the rack.

The crossbar engaging portion of each support hook extends upwardly between the panels or legs of the crossbar and into engagement with and extending partially around a crossbeam. Preferably, each support hook is a metallic rod made of steel or other metal bar stock and formed into partially surrounding engagement with a crossbeam. Thereafter, the rod is bent to loop around into one or more and preferably two loops to extend into engagement against the cross web.

The crossbar engaging portion of each support hook is resiliently flexible so that it may be compressed for insertion between its associated crossbeam and the cross web and then released to apply oppositely directed resilient forces against the cross web and the crossbeam.

These resilient forces releasably retain the support hooks in the crossbar.

Preferably, the hook engages the cross web in at least two places which are spaced apart on laterally opposite sides of the crossbeam. This prevents the accidental pivoting of the support hooks about the crossbeams which would allow them to fall out of the rack. Preferably, the support hook extends linearly along the inner surface of the cross web as illustrated in FIG. 2 and has a backturn 76 to facilitate insertion and removal.

There are a variety of alternative ways of forming the rack engaging portion of the support hooks and some of these are illustrated in my copending patent application.

The support hooks may be easily and quickly removed from the main frame of the support rack and yet in operation are held in position with minimal movement. The workpiece engaging portion of the support hook may be grasped, pivoted and either lifted upwardly to raise the bend above the crossbeam and then slid sideways or merely pivoted in a clockwise direction. The entire support hook is then lowered out of the crossbeam. Hooks are replaced in the opposite sequence. The hooks are easily removed by moving a bar or a tool longitudinally along the crossbar to pivot the hooks out of their clamped engagement in the crossbar.

Figure 4:
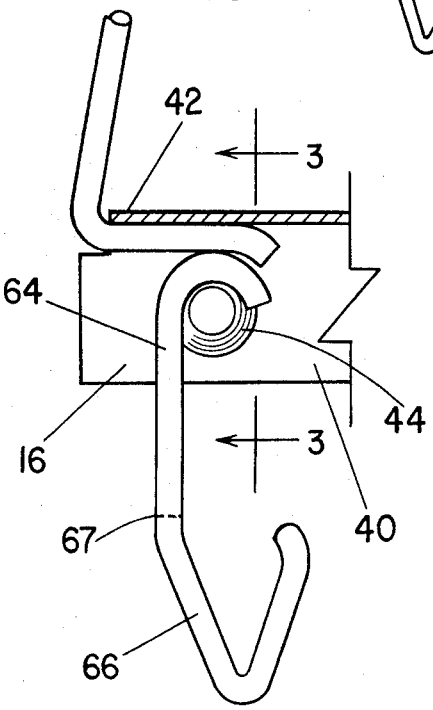
FIG. 4 is a view in vertical section illustrating an alternative embodiment of the present invention.
Figure 4:
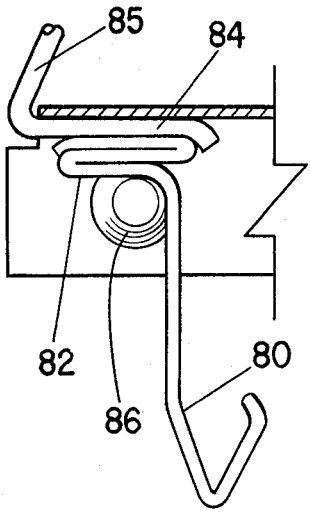

The resilient, compressible, rack engaging portion of the support hooks has a configuration and operation which permits them to be conveniently used as the retaining means to retain the lower legs of the sidebars rigidly in position. Referring to FIG. 4, a support hook 80 having a double looped, rack engaging portion 82 is inserted between the lower leg 84 of the sidebar 85 and the crossbeam 86. It may be inserted or removed in the same manner as it would be inserted if there was no sidebar leg 84. However, its oppositely directed forces are now directed not only against the crossbeam 86 but against the leg 84 of the sidebar to hold it rigidly in place.

Figure 5:
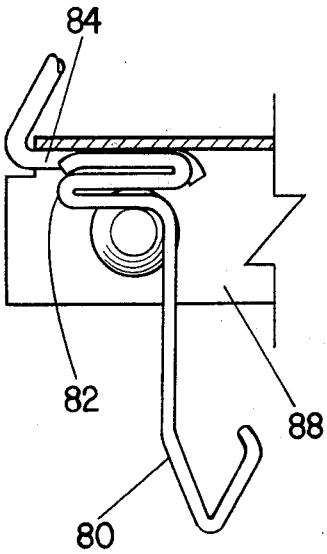
FIG. 5 is a view in vertical section of the embodiment of the invention illustrated in FIG. 4 in a slightly different position.

As illustrated in FIG. 5, the rack engaging portion 82 of the support hook 80 may slip to one side or the other of the sidebar leg 84 because the support hook 80 may be formed of a considerably smaller diameter bar stock. However, this is no problem because the uppermost portion of the support hook 80 will be wedged between the side panel of the crossbar 88 and the surface of the leg 84.

Figure 6:
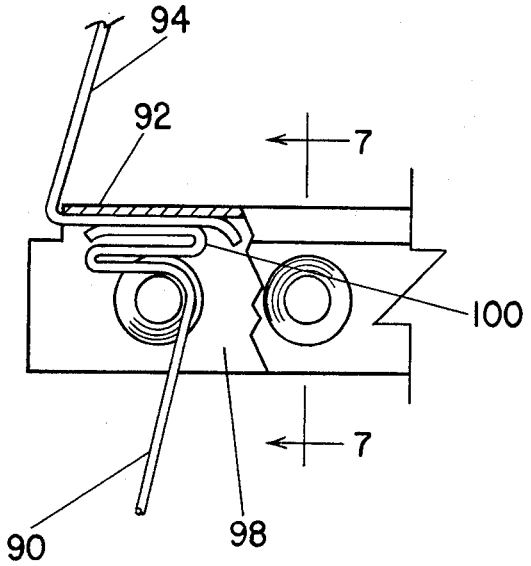
FIG. 6 is a side view partly in vertical section illustrating yet another alternative embodiment of the invention.
Figure 7:
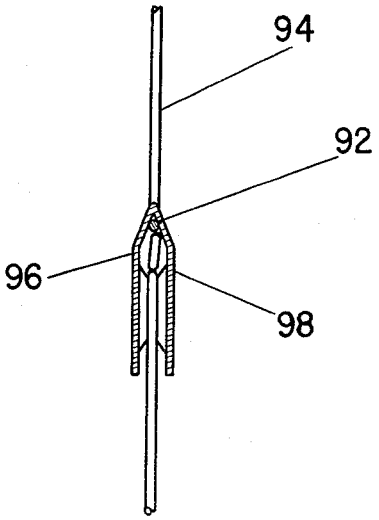
FIG. 7 is a view in vertical section taken substantially along the line 7—7 of FIG. 6.

FIGS. 6 and 7 illustrate yet another embodiment of the invention in which the sidebars are formed of a considerably smaller bar stock and used with a retaining means formed like the rack engaging portion of a support hook. With the embodiment illustrated in FIGS. 6 and 7, the small diameter leg 92 of the sidebar 94 is wedged in the groove 96 which was formed in the cross web of the crossbar 98. The leg 92 is held rigidly in this position by the upwardly directed force of the double looped rack engaging portion 100 of the lower sidebar 90.

The embodiments of the invention are assembled from the top down. Thus, the first two opposite sidebars are attached at their upper ends to the top crossbar. The next lower crossbar then receives the leg of each sidebar. Thereafter, the retaining means is inserted between the leg and its associated crossbeam to lock the sidebar and crossbar together.

Figure 8:
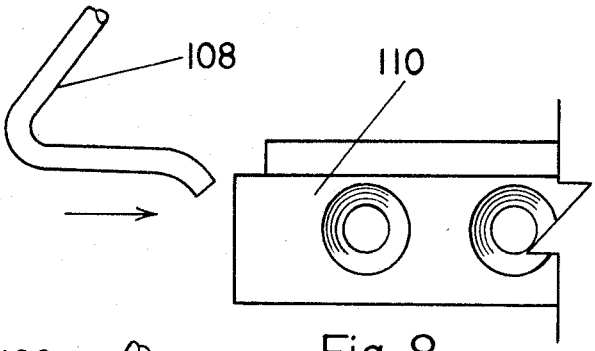
FIGS. 8, 9 and 10 are diagrammatic views illustrating the assembly of the preferred sidebars embodying the present invention.
Figure 9:
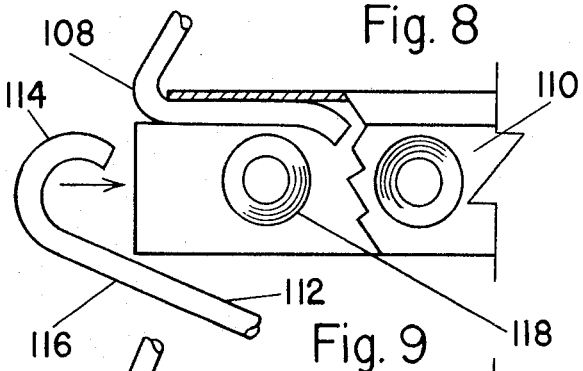
Figure 10:
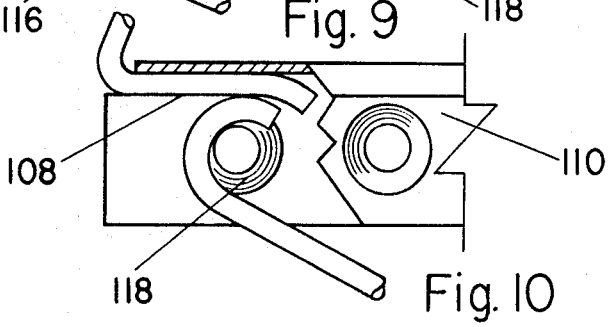

FIGS. 8 through 10 illustrate the insertion of the inwardly bent leg of a sidebar 108 into the crossbar 110 to the position illustrated in FIG. 9. Thereafter, the next crossbar 112 is inclined as illustrated so that the tip 114 of its hook-shaped end 116 may be inserted between the crossbeam 118 and the inwardly bent leg of sidebar 108 as illustrated in FIG. 10. The sidebar 112 is then pivoted or rotated about the center of the crossbeam 118 so that it then extends downwardly for attachment to the next lower crossbar in the identical manner. The finishing support rack embodying the present invention is disassembled in the opposite sequence, from the bottom up.

A plurality of sidebars may be prefabricated having considerably different lengths. For example, they may be constructed in lengths ranging from 4 to 36 inches at 2 inch intervals. Each sidebar will have an upper hook-shaped end and a lower inwardly extending leg in the same form as illustrated in FIG. 2. The only other difference besides length is that the angle between the inwardly extending leg and the nearly vertical portion of each sidebar is nearer 90° for the longer sidebars and becomes more acute as the sidebar is made shorter.

From the above it can be seen that the component parts of a support rack embodying the present invention may be prefabricated with sidebars of varying lengths. Crossbars, of course, may also be prefabricated in varying lengths and the hooks may be prefabricated in a variety of hook sizes and wire sizes and a variety of workpiece engaging shapes. When an order is received for finishing support racks with a particular size and crossbar spacings, the appropriate components are selected and packaged in a disassembled form for shipment to the purchaser. The purchaser then merely assembles the component parts into the support racks which he ordered. He has the further option of ordering additional sidebars of different lengths so that he may thereafter change the painting support rack to accommodate different workpieces and different jobs.

One very important and major advantage of the structure of the present invention is that the interfacing surfaces of all the interlocking component parts of the support rack are protected and shielded within the crossbars. Therefore, electrical contact is maintained throughout the entire support rack despite the reuse of the support racks and the reuse of the component parts in different assemblies to form different support racks. The interlocking parts are kept free from the coating material which not only maintains the electrical contact but facilitates the disassembly and reassembly of the components because their mechanically engaging regions are uncoated.

A single-piece crossbar is formed which not only completely shields the electrical contact between the support hooks and both the crossbeam and cross web portions of the crossbar, but also provides rigid support for the entire rack. The hooks are directly releasable with a minimum of manual manipulation and movement. During use they are held rigidly in place under spring tension.

The simplicity with which the hooks may be removed and replaced and the simplicity of disassembly of the sidebars from the crossbars represents a significant labor and material savings. Because the structure is simpler, its cost of manufacture is low and because the shield serves two functions, both shielding and structural weight supporting, less metal is used, fewer parts are needed and therefore fewer parts are needed to be assembled during manufacture.

The groove and hook structure further permits the hooks and the sidebars to be constructed from a wide range of wire diameters and still seat rigidly but removably in the center of the grooves. This allows wire size to be custom selected for the size and weight of the workpieces.

Figure 11:
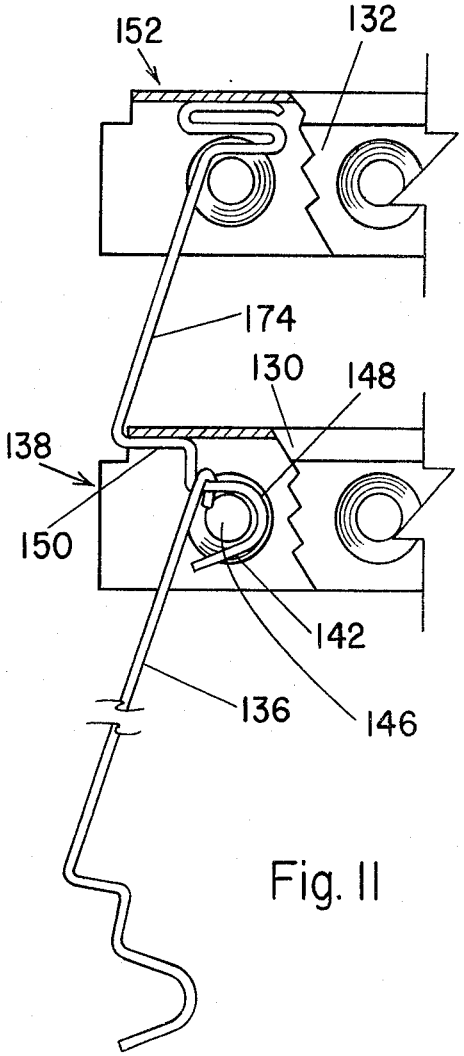
FIG. 11 is a view in vertical section of an alternative removable sidebar structure.

FIG. 11 illustrates still another alternative sidebar structure which provides the above advantages and is particularly suitable for sidebars constructed of relatively small wire or bar stock. The crossbars 130 and 132 and the entire support rack, except for the sidebars 134 and 136, are formed in exactly the same manner as described above.

The sidebars, however, are bent into a somewhat different shape and engage and lock with the crossbars in a different manner. The sidebars 134 and 136 both have their lower portions identically formed. Considering the sidebar 134 for example, it is formed with a lower end 138 which engages the end edge 140 of the associated sidebar 130, is bent to form a leg 142 which extends along the underside of the cross web 144 and above the crossbeam 146 and thereafter is bent around the inner side of the crossbeam 146 into a hook-shape portion 148.

The upper end of the sidebar 136 is formed with a hook-shape end 150 for hanging over a portion of the sidebar 134.

The sidebar 134 is dimensioned so that its hook-shaped lower end 148 seats against the interior side of the crossbeam 146 and also seats against the end edge of the crossbar 144. Its upper end 152 is engaged in the upper crossbar 132. Consequently, lateral movement of the crossbar 130 is prevented by the sidebar 134 as well as the sidebar provided at the opposite end of the support rack.

Most of the sidebars will have the upper hook end formed like the hook end 150 of the sidebar 136. This engagement of a relatively lower sidebar with the leg 142 of the relatively higher sidebar 134 further locks the sidebar 134 into its engagement with the crossbar 130.

However, the upper end of the topmost sidebars, such as the upper end 152 of the sidebar 134, will not have an available sidebar on which to hook. Therefore, the upper end 152 will be formed in the same manner as the upper end of the support hooks which are illustrated in FIG. 2 and will engage the cross web and crossbeams in the same manner.

This rack is assembled from the bottom up and disassembled from the top down.

I claim:

1. A support rack of the type having a main frame and workpiece support hooks on which workpieces are hung for transporting the workpieces through a finishing system, said rack, in an operable position, including:

(a) a plurality of generally horizontal, vertically spaced crossbars each having opposed spaced panels, a cross web extending between and longitudinally along said panels and at least one crossbeam near each end of each crossbar extending between said panels and spaced from said cross web;

(b) a plurality of manually removable sidebars extending between the adjacent, vertically spaced ends of said crossbars, each sidebar having an upper end for hanging over an upper one of said crossbeams and a lower, inwardly bent leg extending along the underside of a cross web and above a crossbeam of a relatively lower one of said crossbars to a down turned tip; and (c) removable retaining means inserted between each of said lower legs and its associated crossbeam for extending from said crossbeam to said leg for preventing significant movement of said leg and interfering with said turned down tip to prevent withdrawal of said leg.

2. A rack in accordance with claim 1 wherein said retaining means comprises the rack engaging portion of a support hook.

3. A rack in accordance with claim 1 wherein said retaining means comprises a hook-shaped upper end of another sidebar extending downwardly to another crossbar.

4. A rack in accordance with claim 1 wherein said retaining means comprises a hook-shaped, rack engaging upper end portion of a support hook.

5. A rack in accordance with claim 1 wherein each of said retaining means is resiliently flexible and applies oppositely directed resilient forces against its associated lower leg and crossbeam.

6. A rack in accordance with claim 5 wherein each of said retaining means comprises a metallic rod bent into engagement with said crossbeam and thereafter looping around into engagement with said lower leg in at least two places with one spaced on laterally opposite sides of said associated crossbeam.

7. A rack in accordance with claim 6 wherein said retaining means is the upper end of another sidebar extending downwardly to another crossbar.

8. A rack in accordance with claim 6 wherein said retaining means comprises the rack engaging portion of a support hook.

9. A support rack of the type having a main frame and workpiece support hooks on which workpieces are hung for transporting the workpieces through a finishing system, said rack, in an operable position, including:

(a) a plurality of generally horizontal, vertically spaced crossbars each having opposed spaced panels, a cross web extending between and longitudinally along said panels and at least one crossbeam near each end of each crossbar extending between said panels and spaced from said cross web; and (b) a plurality of manually removable sidebars extending between the adjacent, vertically spaced ends of said crossbars, each sidebar having a hook-shaped upper end for hanging over a relatively higher sidebar and a lower end engaging the end edge of an associated crossbar and bent to form a leg extending along the underside of the cross web and above a crossbeam of said associated crossbar and thereafter bent around the inner side of the crossbeam of said associated crossbar.

* * * * *